US006695173B1

(12) United States Patent
Fontana

(10) Patent No.: US 6,695,173 B1
(45) Date of Patent: Feb. 24, 2004

(54) MULTIPLE-DOSE BOTTLE WITH DOSAGE NOZZLE FOR LIQUIDS, PARTICULARLY FOR PHARMACEUTICAL PRODUCTS

(75) Inventor: Antonio Fontana, Carpi (IT)

(73) Assignee: MRP Medical Research & Promotion Establishment, Vaduz (LI)

( * ) Notice: Subject to any disclaimer, the term of this patent is extended or adjusted under 35 U.S.C. 154(b) by 0 days.

(21) Appl. No.: 10/019,582

(22) PCT Filed: Jun. 15, 2000

(86) PCT No.: PCT/EP00/05520

§ 371 (c)(1),
(2), (4) Date: Dec. 21, 2001

(87) PCT Pub. No.: WO01/00498

PCT Pub. Date: Jan. 4, 2001

(30) Foreign Application Priority Data

Jun. 24, 1999 (IT) ..... MO99A0140

(51) Int. Cl.[7] ..... B65D 37/00

(52) U.S. Cl. ..... 222/212; 222/213; 222/215; 222/206; 222/494; 604/132; 604/247

(58) Field of Search ..... 222/212, 213, 222/215, 206, 494; 604/247, 132, 142

(56) References Cited

U.S. PATENT DOCUMENTS 1,922,204 A * 8/1933 Johnson ..... 222/494
2,695,119 A * 11/1954 Kishpaugh et al. ..... 222/494
2,715,980 A * 8/1955 Frick ..... 222/183
2,974,835 A * 3/1961 Herbrick ..... 222/507
4,420,101 A * 12/1983 O'Neill ..... 222/212
4,561,570 A * 12/1985 Zulauf et al. ..... 222/153.14
4,739,906 A * 4/1988 LoTurco ..... 222/212
4,785,978 A * 11/1988 Kano et al. ..... 222/482
4,807,784 A * 2/1989 Jupin et al. ..... 222/207
5,033,655 A * 7/1991 Brown ..... 222/212
5,226,568 A * 7/1993 Newton et al. ..... 222/212
5,320,254 A * 6/1994 Ranalletta et al. ..... 222/189.08
5,431,310 A * 7/1995 Kanner et al. ..... 222/212
5,454,494 A * 10/1995 Lechelle ..... 222/494
5,456,374 A * 10/1995 Beck ..... 215/251

FOREIGN PATENT DOCUMENTS

DE 582098 A * 11/1976 ..... B65D/35/40
FR 1275963 * 10/1961
JP 11240553 A * 9/1999 ..... B65D/47/20

* cited by examiner

*Primary Examiner*—Gene Mancene
*Assistant Examiner*—Frederick Nicolas
(74) *Attorney, Agent, or Firm*—Wolf, Greenfield, & Sacks

(57) ABSTRACT

A multiple-dose bottle with dosage nozzle for liquids, particularly for pharmaceutical products, is deformable and has a nozzle (2) which comprises a valve (3) made of flexible material which can be coupled to the mouth (4) of the bottle (1) and has a plurality of passages (5) for the flow of the liquid and a cap (6) made of substantially rigid material which is fitted hermetically on the valve (3) and is provided, in an upward region, with a dispensing opening (7), compression of the bottle (1) producing the compression of the valve (3), the flow of the liquid between the valve (3) and the cap (6), and the release of the liquid through the dispensing opening (7).

20 Claims, 5 Drawing Sheets

MULTIPLE-DOSE BOTTLE WITH DOSAGE NOZZLE FOR LIQUIDS, PARTICULARLY FOR PHARMACEUTICAL PRODUCTS

This application is a national stage filing under 35 U.S.C. §371 of PCT International application PCT/EP00/05520, filed Jun. 15, 2000, which was published under PCT Article 21(2) in English.

TECHNICAL FIELD

The present invention relates to a multiple-dose bottle with dosage nozzle for liquids, particularly for pharmaceutical products.

BACKGROUND ART

It is known that some products, such as for example medicines and pharmaceutical products, if contained in multiple-dose bottles, use preservatives in order to avoid possible bacterial contaminations due to direct contact of the contained product with the surrounding air.

Applicable statutory provisions prescribe for the near future the elimination of these preservatives from multiple-dose bottles, and this disadvantageously makes that conventional types of said bottles which do not ensure complete asepsis of the product are inadequate.

As an alternative, in order to obviate this drawback of conventional multiple-dose bottles, single-dose bottles, meant to be used only once and therefore requiring no preservatives, are used for the dosage of these products.

However, even these single-dose bottles are not devoid of drawbacks, including the fact that for an equal contained volume they require larger dimensions and higher production costs than multiple-dose bottles.

Furthermore, asepsis of the product is ensured by wasting material due to the fact that single-dose bottles are discarded after a single application of the product.

DISCLOSURE OF THE INVENTION

The aim of the present invention is to eliminate the above-noted drawbacks of conventional types of bottle by providing a multiple-dose bottle with dosage nozzle for liquids, particularly for pharmaceutical products, which allows to fully eliminate the use of preservatives which are harmful to human health, to contain an aseptic product which can be used even more than once and to reduce the waste of material and therefore the production and packaging costs of bottles for an equal volume of contained product.

Within the scope of this aim, an object of the present invention is to achieve the above-cited aim with a structure which is simple, relatively easy to provide in practice, safe in use, effective in operation, and relatively low in cost.

This and other objects are achieved by the present multiple-dose bottle with dosage nozzle for liquids, particularly for pharmaceutical products, characterized in that said bottle is deformable and that said nozzle comprises a valve made of flexible material which can be coupled to the mouth of the bottle and has a plurality of passages for the flow of the liquid and a cap made of substantially rigid material which is fitted hermetically on said valve and is provided, in an upward region, with a dispensing opening, compression of the bottle producing the compression of the valve, the flow of the liquid between the valve and the cap, and the release of said liquid through said dispensing opening.

BRIEF DESCRIPTION OF THE DRAWINGS

Further characteristics and advantages of the present invention will become better apparent from the following detailed description of a preferred but not exclusive embodiment of a multiple-dose bottle with dosage nozzle for liquids, particularly for pharmaceutical products, illustrated only by way of non-limitative example in the accompanying drawings, wherein.

WAYS OF CARRYING OUT THE INVENTION

Figure 1:
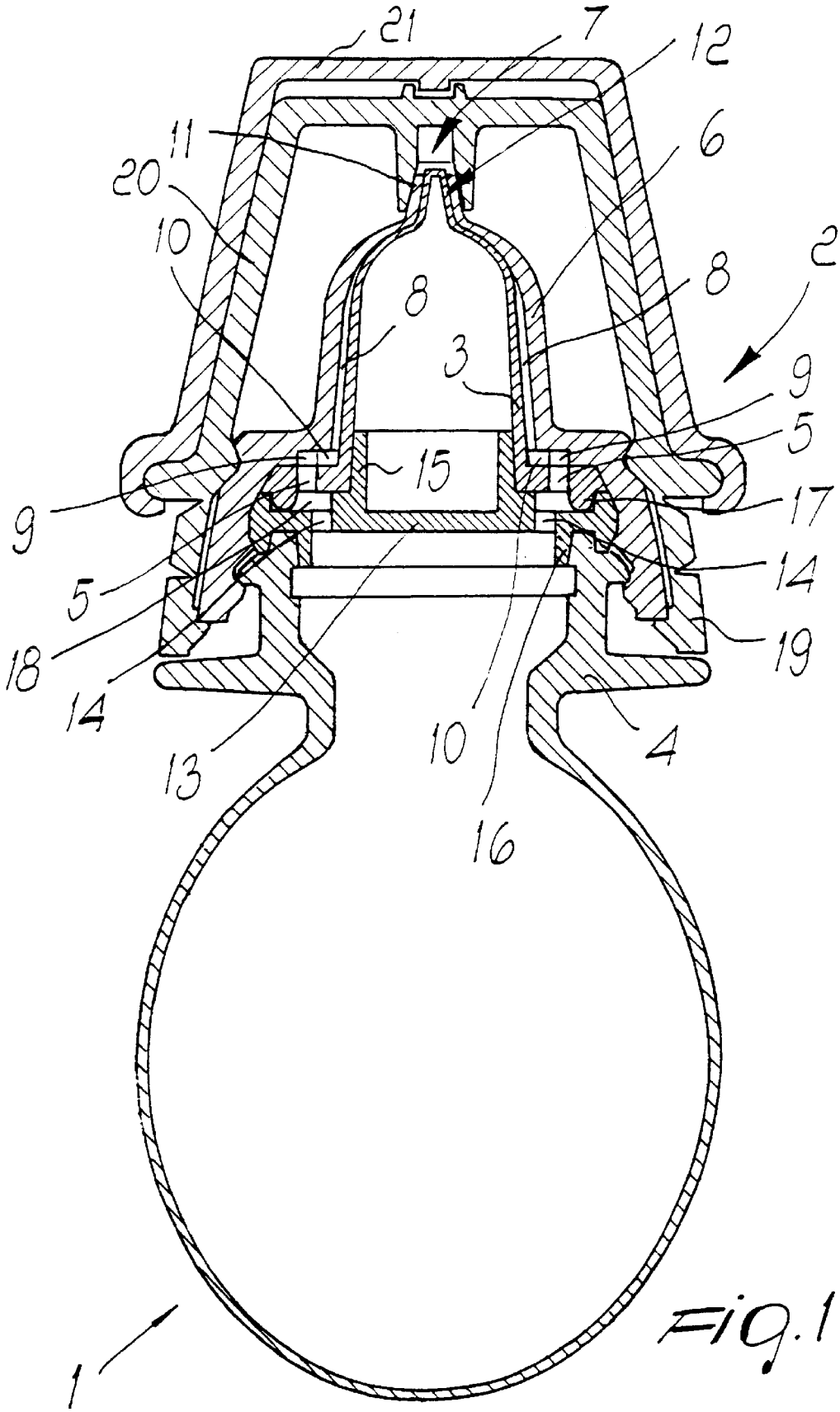
FIG. 1 is a sectional front view of a multiple-dose bottle with dosage nozzle for liquids, particularly for pharmaceutical products, according to the invention.
Figure 2:
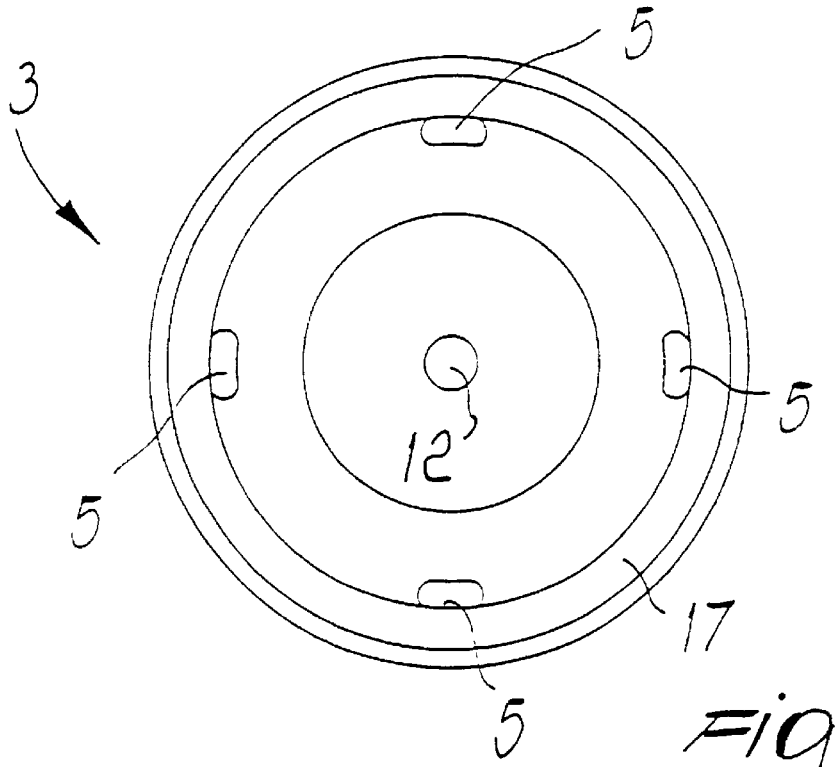
FIG. 2 is a top view of the valve of the bottle according to the invention.
Figure 3:
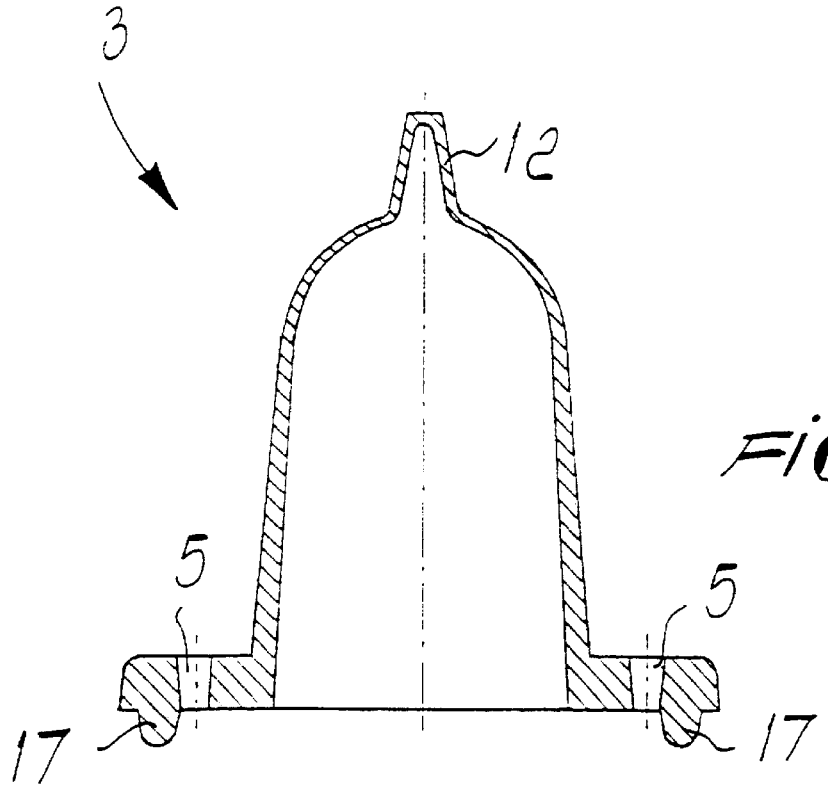
FIG. 3 is a sectional view of the valve of the bottle according to the invention.
Figure 4:
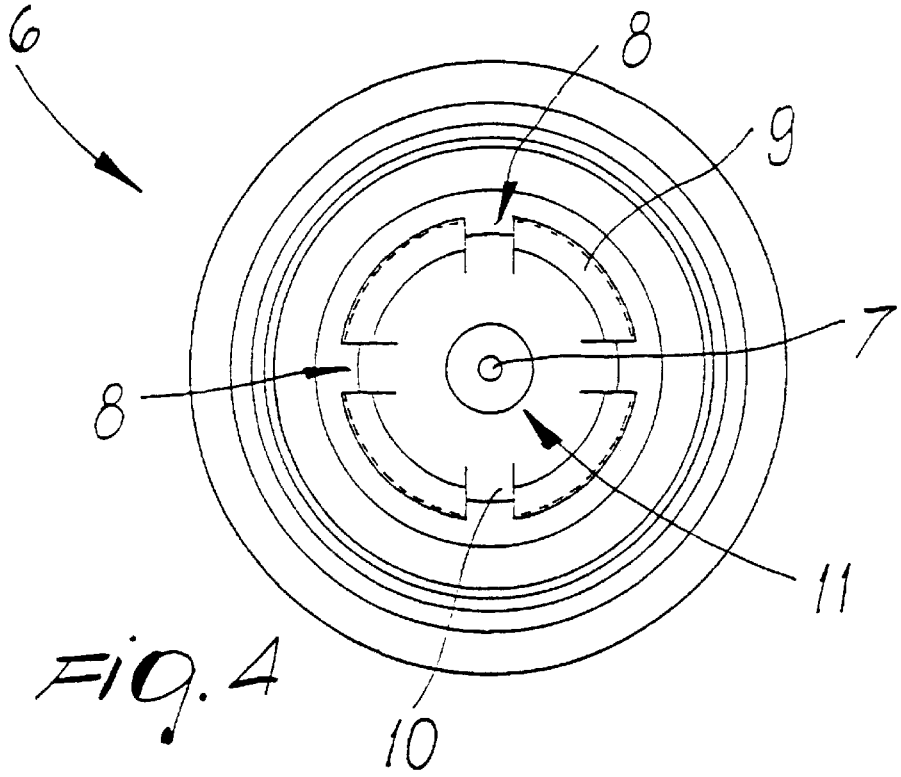
FIG. 4 is a top view of the cap of the bottle according to the invention.
Figure 5:
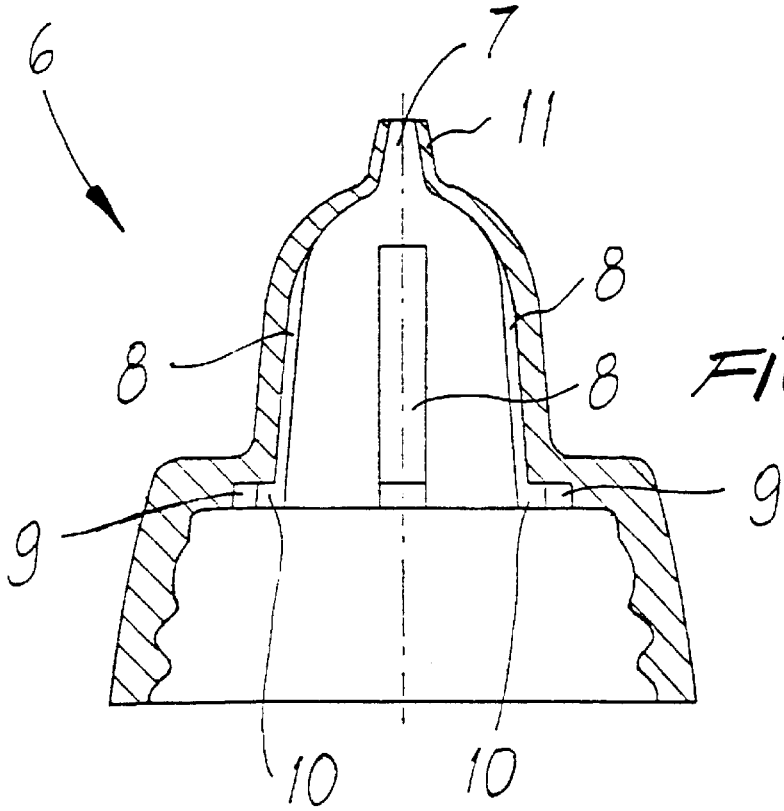
FIG. 5 is a sectional view of the cap of the bottle according to the invention.
Figure 6:
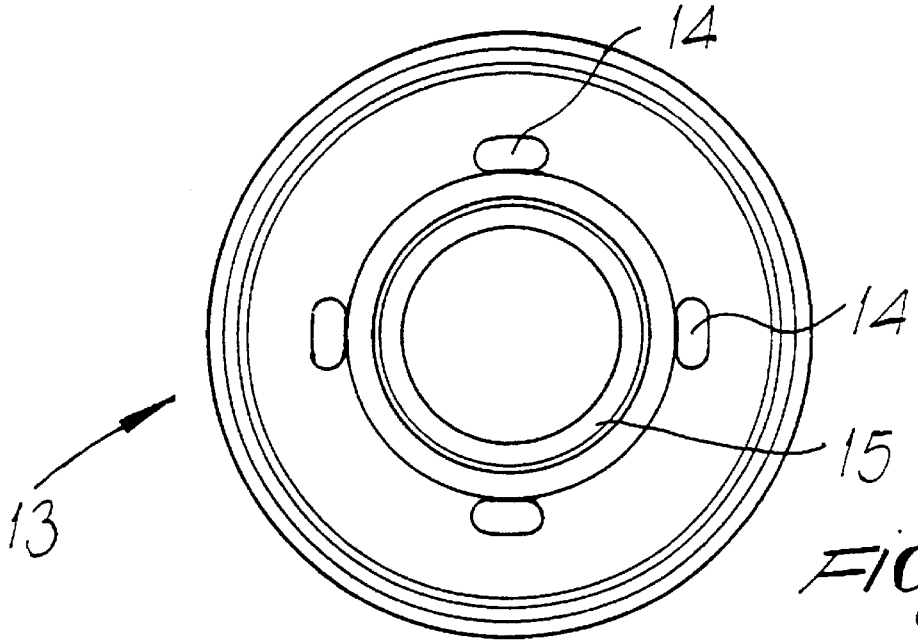
FIG. 6 is a top view of the gasket of the bottle according to the invention.
Figure 7:
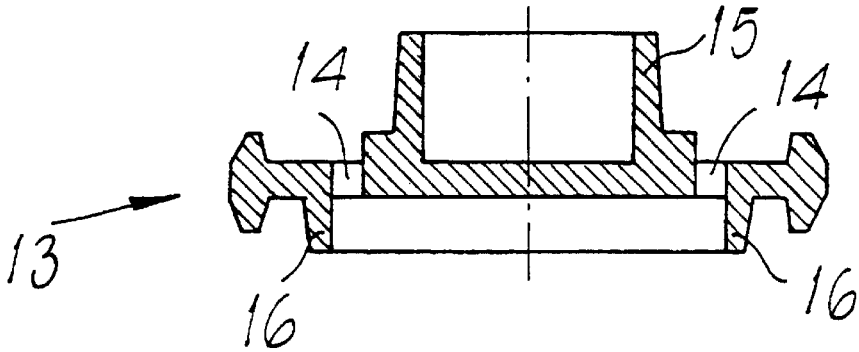
FIG. 7 is a sectional view of the gasket of the bottle according to the invention.
Figure 8:
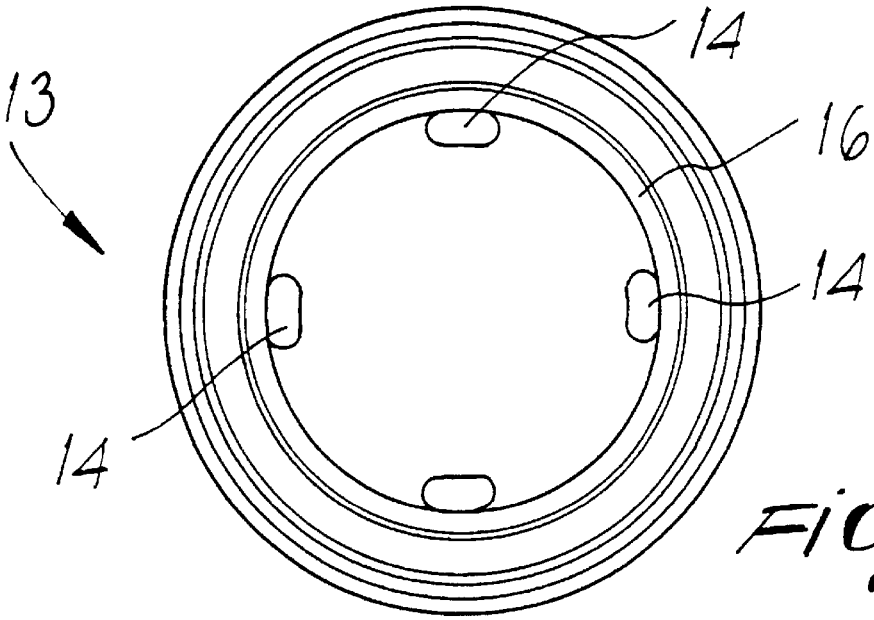
FIG. 8 is a bottom view of the gasket of the bottle according to the invention.
Figure 9:
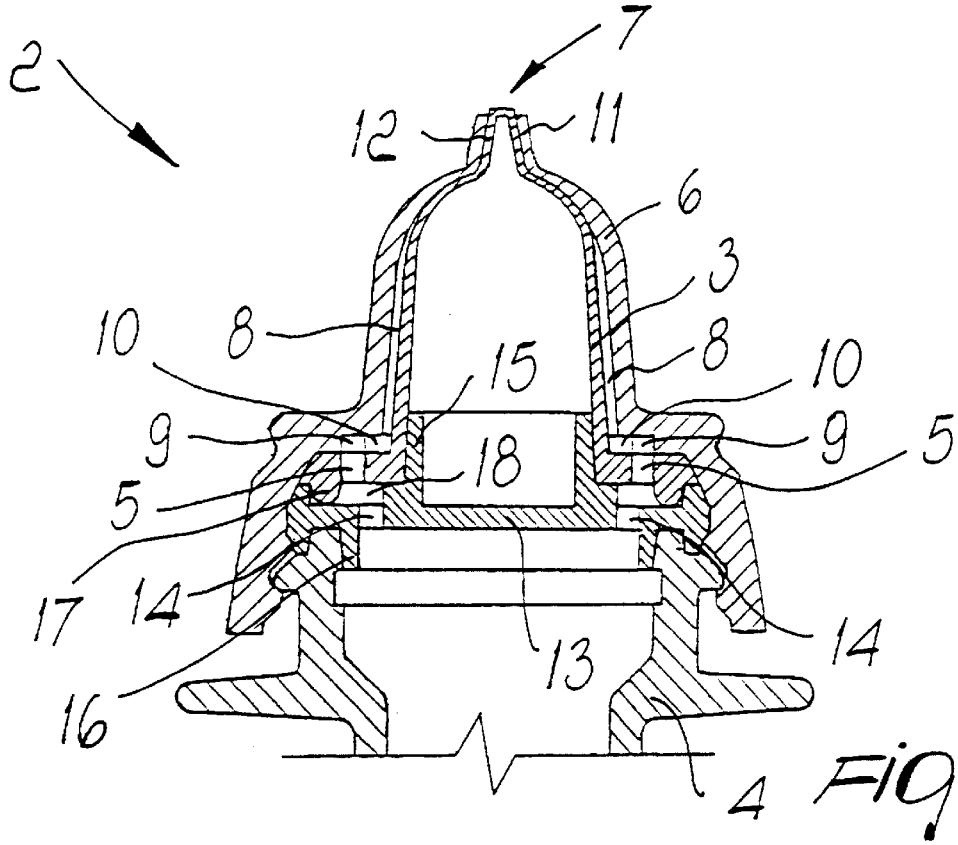
FIG. 9 is a sectional view of the nozzle of the bottle according to the invention when not in use.
Figure 10:
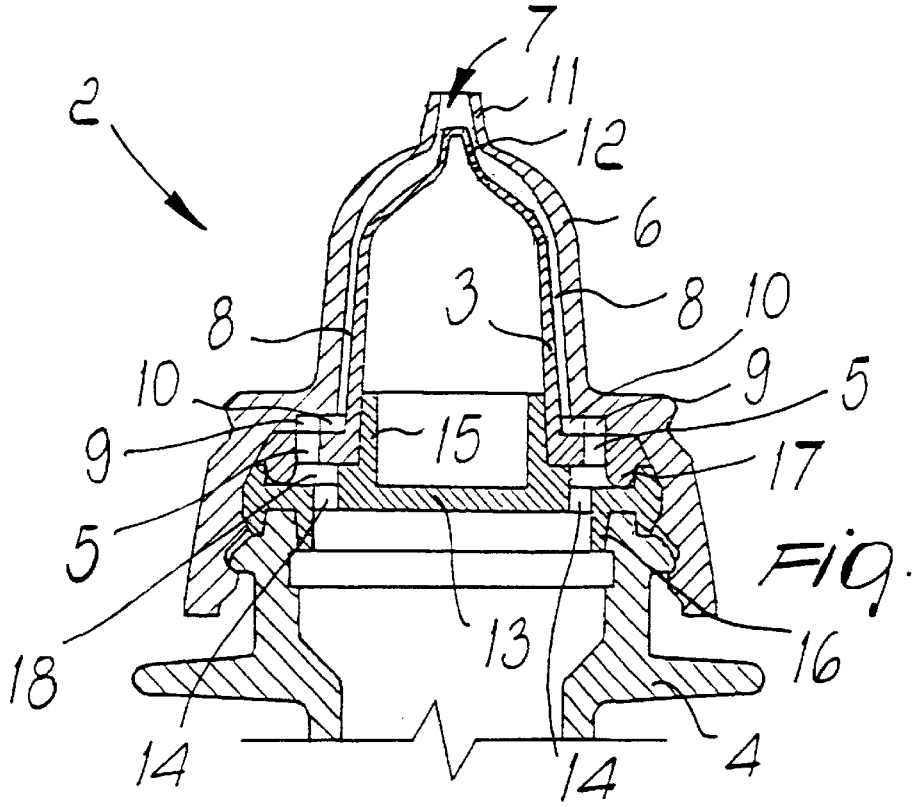
FIG. 10 is a sectional view of the nozzle of the bottle according to the invention in the dispensing configuration.

With reference to the above figures, 1 generally designated a multiple-dose bottle with dosage nozzle for liquid products.

The bottle 1 is made of highly deformable material and is provided with a nozzle 2 which comprises a valve 3 made of flexible material which can be coupled to the mouth 4 of the bottle 1 and has a plurality of passages 5 for the flow of the liquid.

A cap 6, made of substantially rigid material, is fixed at its lower part to the mouth 4, is fitted hermetically on the valve 3 and has, in an upward region, a dispensing opening 7.

Compression of the bottle 1 produces the compression of the upper portion of the valve 3, the separation of the cap 6 from the internal wall and the flow of the liquid between said valve and the cap 6, with subsequent release through the dispensing opening 7.

The cap 6 furthermore has a plurality of symmetrically arranged longitudinal grooves 8 for the flow of the liquid, an annular groove 9, and a plurality of radial notches 10 for connection between the annular groove 9 and the longitudinal grooves 8.

The dispensing opening 7 is formed at an external protrusion 11 which is substantially nipple-shaped.

Near the protrusion 11, the valve 3 is provided with a pin 12 for closing the opening 7 and is thinner so as to facilitate the compression of the liquid being released and its consequent flow between the cap and the valve.

A sealing gasket 13 is arranged between the mouth 4 of the bottle 1 and the valve 3 and has a plurality of holes 14 for the flow of the liquid, an upper annular raised portion 15 for coupling to the valve 3, and a lower annular raised portion 16 for coupling to the mouth of the bottle 4.

The upper raised portion 15 allows to keep the internal chamber of the valve 3 at a pressure which makes the upper part of the valve adhere perfectly to the rigid cap 6.

The valve 3 is provided, in a downward region, with an annular raised portion 17 which is adapted to form an annular channel 18 for collecting the liquid between the passages 5 and the holes 14 of the gasket 13: in this way the holes and the liquid flow passages need not be matched up.

A ring 19 is rigidly coupled to the mouth 4 of the bottle 1, is connected through conventional sealing means to a dome-shaped cover 20 for closing the cap 6, and can be eliminated once the sealing means have been removed.

It is possible to fix above the cover 20 a safety top 21 of the child-proof type; however, embodiments of the invention which do not have the cover 20 and/or the safety top 21 must not be excluded.

It is also possible to have the cap 6 or the mouth 4 extend downwards with a partial enclosure, not shown, which is adapted to support the bottle in a vertical position.

The bottle 1, the cap 6, the valve 3 and the gasket 13 are made of a material such as plastic and/or rubber, are sterilizable, inert and impermeable to liquids.

In addition to the pear-shaped type, as shown in FIG. 1, it is possible to provide several alternative embodiments of the bottle, including the vertical and horizontal cylindrical or accordion types.

The operation of the invention is as follows:

By compressing the deformable bottle, the liquid that flows out of the mouth 4 passes through the plurality of holes 14 of the gasket 13, reaches the annular channel 18, flows from there into the annular groove 9 of the cap 6, through the passages 5, and finally reaches the longitudinal grooves 8 through the notches 10, where it compresses the upper thinner portion of the valve 3 which adheres to the respective internal part of the cap 6.

This compression overcomes the force applied by the air contained in the valve 3 and produces a lowering and consequent separation of the upper portion of the valve 3 from the cap 6 and of the pin 12 from the dispensing opening 7, thus allowing liquid to flow between the valve and the cap and to subsequently be released through this opening.

When the bottle is released, the upper part of the valve 3 is no longer subjected to any force and returns to the initial sealing position under the action of the air contained internally; the pin 12 likewise returns to close the opening 7.

At the same time, the liquid being released that is still present at the opening 7 and is therefore in contact with the surrounding outside environment is expelled, thus eliminating any reverse flow of liquid and entry of contaminants.

At rest, the valve 3 adheres perfectly to the cap 6 and prevents all possible external contamination as well as any release of liquid contained in the bottle 1.

The invention thus conceived is susceptible of numerous modifications and variations, all of which are within the scope of the inventive concept.

All the details may further be replaced with other technically equivalent ones.

In practice, the materials employed, as well as the shapes and the dimensions, may be any according to requirements without thereby abandoning the scope of the protection of the appended claims.

The disclosures in Italian Patent Application No. M099A000140 from which this application claims priority are incorporated herein by reference.

What is claimed is:

1. A multiple-dose bottle with dosage nozzle for liquids, particularly for pharmaceutical products, wherein said bottle is deformable and said nozzle comprises a valve made of flexible material couplable to the mouth of the bottle and has a plurality of passages for the flow of the liquid and a cap made of substantially rigid material which is fitted hermetically on said valve and is provided, in an upward region, with a dispensing opening, compression of the bottle producing the compression of the valve, the flow of the liquid between the valve and the cap, and the release of said liquid through said dispensing opening, and a sealing gasket interposed between said mouth and said valve having a plurality of holes for the passage of the liquid.

2. The bottle according to claim 1, wherein the opening of said cap is substantially axial and is formed at an external protrusion which is substantially nipple-shaped.

3. The bottle according to claim 1, wherein said valve has, in a downward region, an annular raised portion which is adapted to create an annual channel for collecting the liquid between the passages of said valve and the holes of said gasket.

4. The bottle according to claim 1, wherein said valve has, in an upward region, a pin for closing said opening.

5. The bottle according to claim 1, wherein said valve is made of a material such as rubber which is sterilizable, inert and impermeable to liquids.

6. The bottle according to claim 1, wherein said cap and said gasket are made of a material such as plastic which is sterilizable, inert and impermeable to liquids.

7. The bottle according to claim 1, wherein said cap and said gasket are made of a material such as rubber which is sterilizable, inert and impermeable to liquids.

8. The bottle according to claim 1, wherein said valve is thinner at its end region to allow the flow of liquid and is thicker in a downward region in order to hermetically close against the surface of the gasket.

9. The bottle according to claim 1, wherein a ring is coupled at said mouth and is connected by way of removable sealing means to a dome-shaped cover for closing said cap.

10. The bottle according to claim 1, wherein said cap continues downwards with a partial enclosure for supporting the bottle in a vertical position.

11. The bottle according to claim 1, wherein said mouth continues downwards and outwards with a partial enclosure for supporting the bottle in a vertical position.

12. A multiple-dose bottle with dosage nozzle for liquids, particularly for pharmaceutical products, wherein said bottle is deformable and said nozzle comprises a valve made of flexible material couplable to the mouth of the bottle and has a plurality of passages for the flow of the liquid and a cap made of substantially rigid material which is fitted hermetically on said valve and is provided, in an upward region, with a dispensing opening, compression of the bottle producing the compression of the valve, the flow of the liquid between the valve and the cap, and the release of said liquid through said dispensing opening, a sealing gasket interposed between said mouth and said valve having a plurality of holes for the passage of the liquid, and wherein said gasket comprises a lower annular raised portion for coupling to the mouth of the bottle and an upper annular raised portion for hermetic coupling to the lower portion of the valve.

13. The bottle according to claim 12, wherein a safety top is fittable on said cover.

14. A multiple-dose bottle with dosage nozzle for liquids, particularly for pharmaceutical products, wherein said bottle is deformable and said nozzle comprises a valve made of flexible material couplable to the mouth of the bottle and has a plurality of passages for the flow of the liquid and a cap made of substantially rigid material which is fitted hermetically on said valve and is provided, in an upward region, with a dispensing opening, compression of the bottle producing the compression of the valve, the flow of the liquid between the valve and the cap, and the release of said liquid through said dispensing opening, wherein said cap can be fixed at its lower part to said mouth and comprises, along the internal surface, a plurality of longitudinal grooves for the passage of the liquid.

15. The bottle according to claim 14, wherein said cap comprises, in a downward region, an internal annular groove for the passage of the liquid and plurality of notches for connection between said longitudinal grooves and said annular groove.

16. The bottle according to claim 14, wherein the opening of said cap is substantially axial and is formed at an external protrusion which is substantially nipple-shaped.

17. The bottle according to claim 14, wherein said valve has, in an upward region, a pin for closing said opening.

18. The bottle according to claim 14, wherein a ring is coupled at said mouth and is connected by way of removable sealing means to a dome-shaped cover for closing said cap.

19. The bottle according to claim 14, wherein said cap continues downwards with a partial enclosure for supporting the bottle in a vertical position.

20. The bottle according to claim 14, wherein said mouth continues downwards and outwards with a partial enclosure for supporting the bottle in a vertical position.

* * * * *